US010016802B2

(12) United States Patent
Tomizawa et al.

(10) Patent No.: US 10,016,802 B2
(45) Date of Patent: Jul. 10, 2018

(54) METHOD AND APPARATUS FOR MANUFACTURING A BENT PRODUCT

(71) Applicants: NIPPON STEEL & SUMITOMO METAL CORPORATION, Tokyo (JP); NIPPON STEEL & SUMIKIN PIPE CO., LTD., Tokyo (JP)

(72) Inventors: Atsushi Tomizawa, Tokyo (JP); Naoaki Shimada, Tokyo (JP); Saburo Inoue, Tokyo (JP); Shinjiro Kuwayama, Tokyo (JP)

(73) Assignees: NIPPON STEEL & SUMITOMO METAL CORPORATION, Tokyo (JP); NIPPON STEEL & SUMIKIN PIPE CO., LTD., Tokyo (JP)

( * ) Notice: Subject to any disclaimer, the term of this patent is extended or adjusted under 35 U.S.C. 154(b) by 0 days.

(21) Appl. No.: 15/782,902

(22) Filed: Oct. 13, 2017

(65) Prior Publication Data

US 2018/0043411 A1 Feb. 15, 2018

Related U.S. Application Data

(60) Division of application No. 13/091,431, filed on Apr. 21, 2011, now Pat. No. 9,821,357, which is a (Continued)

(30) Foreign Application Priority Data

Oct. 28, 2008 (JP) ..... 2008-276494

(51) Int. Cl.
*B21D 7/16* (2006.01)
*B21D 7/12* (2006.01)

(52) U.S. Cl.
CPC ..... *B21D 7/16* (2013.01); *B21D 7/12* (2013.01)

(58) Field of Classification Search
CPC ..... B21D 7/16
See application file for complete search history.

(56) References Cited

U.S. PATENT DOCUMENTS 4,056,960 A 11/1977 Kawanami
4,061,005 A 12/1977 Kawanami et al.
(Continued)

FOREIGN PATENT DOCUMENTS

CA 2 682 815 10/2008
CN 1856375 11/2006
(Continued)

OTHER PUBLICATIONS

JP2013-136788 Appeal Decision with English translation, Nov. 10, 2015.

(Continued)

*Primary Examiner* — Christopher Kessler
(74) *Attorney, Agent, or Firm* — Clark & Brody

(57) ABSTRACT

A bent product having a three-dimensionally bent portion intermittently or continuously in the lengthwise direction is manufactured by supporting a steel pipe at a first position A while feeding it in the lengthwise direction, locally heating the steel pipe being fed at a second position B, cooling the heated portion of the steel pipe at a third position C, and varying the position of a gripping means, which grips the steel pipe in a region ID downstream of the third position C, in a three-dimensional direction including the feed direction of the steel pipe in a workspace including a space on the upstream side of the third position C in the feed direction of the steel pipe to impart a bending moment to the heated portion of the steel pipe.

1 Claim, 4 Drawing Sheets

Related U.S. Application Data continuation of application No. PCT/JP2009/068381, filed on Oct. 27, 2009.

(56) References Cited

U.S. PATENT DOCUMENTS

| | | | |
|---|---|---|---|
| 4,062,216 | A | 12/1977 | Hanamoto et al. |
| 2008/0066517 | A1 | 3/2008 | Tomizawa |

FOREIGN PATENT DOCUMENTS

| | | |
|---|---|---|
| JP | 56-091630 | 7/1981 |
| JP | 59-38048 | 9/1984 |
| JP | 61-249628 | 11/1986 |
| JP | 01-212780 | 8/1989 |
| JP | 02-179313 | 7/1990 |
| JP | 05-212450 | 8/1993 |
| JP | 10-314852 | 12/1998 |
| JP | 11-156446 | 6/1999 |
| JP | 2000-126821 | 5/2000 |
| JP | 2001-293521 | 10/2001 |
| JP | 2003-306457 | 10/2003 |
| JP | 2004-230320 | 8/2004 |
| JP | 2004-249304 | 9/2004 |
| JP | 2004-269760 | 9/2004 |
| JP | 2006-326667 | 12/2006 |
| JP | 2007-83304 | 4/2007 |
| JP | 2007-301587 | 11/2007 |
| WO | 2006/093006 | 9/2006 |
| WO | 2008/123505 | 10/2008 |

OTHER PUBLICATIONS

Japanese Office Action 2013-136788, dated Apr. 15, 2014, as a concise explanation.

Japanese Office Action for Application No. 2015-038972, dated Mar. 1, 2016.

Office Action for Chinese Application No. 201610306217.4 dated Jul. 11, 2017 and its English translation.

U.S. Office Action for U.S. Appl. No. 13/091,431, dated Feb. 5, 2013.

METHOD AND APPARATUS FOR MANUFACTURING A BENT PRODUCT

This application is a Divisional of U.S. Ser. No. 13/091,431 filed on Apr. 21, 2011, which is a Continuation of PCT/JP2009/068381 filed on Oct. 27, 2009.

TECHNICAL FIELD

This invention relates to a method and an apparatus for manufacturing a bent product (a product formed by bending). More particularly, it relates to a method and an apparatus for manufacturing a bent product capable of manufacturing a bent product which is formed by bending in which the bending direction varies three-dimensionally in an efficient manner and with excellent dimensional accuracy even when the bending angle is high.

BACKGROUND ART

In recent years, due to concern for the global environment, there has been a demand for structural metal materials to be light weight and to have a high strength.

With an increasing demand for safer automobile bodies, there is a further increasing demand for decreases in weight and increases in strength of automotive parts. Initial (starting) metal materials from which automotive parts are manufactured by working are required to have a strength level which is considerably higher than in the past. Therefore, high tensile strength steel sheets having a tensile strength of at least 780 MPa or even at least 900 MPa have been much used as an initial metal material for automotive parts.

As initial metal materials have increased in strength, there has been promoted a rethinking of the structure of automotive parts. For example, there is a strong demand for the development of bending techniques for highly accurate working of parts which are manufactured by continuous bending in which the bending direction varies three-dimensionally in order to manufacture high-strength automotive parts having a complicated shape.

FIGS. 4 and 5 are explanatory views schematically showing a bending apparatus 0 according to the invention which the present applicant disclosed in Patent Document 1 in response to such a demand.

A feed device 3 sends forth a metal material 1, which is supported by a support means 2 so as to be able to move in its axial direction, from an upstream side towards a downstream side. A high frequency heating coil 5 which is disposed on the downstream side of the support means 2 rapidly heats a portion of the metal material 1 to a temperature range in which quenching is possible. A water cooling device 6 which is disposed downstream of the high frequency heating coil 5 rapidly cools the metal material 1. A movable roller die 4 which is disposed on the downstream side of the water cooling device 6 has at least one pair of rolls 4*a* which can support the metal material 1 while feeding it. The movable roller die 4 can move three-dimensionally, thereby imparting a bending moment to the heated portion of the metal material 1 and carrying out bending.

The bending apparatus 0 can manufacture a bent product with a high operating efficiency while maintaining a sufficient bending accuracy. The resulting bent product can have a bent portion which is bent three-dimensionally and a quenched portion intermittently or continuously in the lengthwise direction and/or the circumferential direction in a plane crossing the lengthwise direction. The bending apparatus 0 can manufacture the bent product with high operating efficiency while maintaining sufficient bending accuracy.

Prior Art Document

Patent Document

Patent Document 1: WO 2006/093006

DISCLOSURE OF INVENTION

Problem Which the Invention is to Solve

The present inventors performed diligent investigations in order to improve the invention disclosed in Patent Document 1. FIG. 6 is an explanatory view schematically showing a working method which is disclosed in Patent Document 1. As shown in FIG. 6, a metal material is fed to the left while being supported by two pairs of support rolls 2. The metal material 1 is subjected to various heat treatments including quenching by being rapidly heated in portions by a high frequency heating coil 5 and then being rapidly cooled by a water cooling device 6.

A movable roller die 4 disposed on the downstream side of the water cooling device 6 moves three-dimensionally by a shifting amount H and a tilting angle θ. This movement of the movable roller die 4 applies a bending moment to portion 1*a* which is in a hot state due to being heated by the high frequency heating coil 5. This portion 1*a* is deformed by the bending moment so that the metal material 1 which is fed by the feed device 3 is continuously bent.

In order to further improve the dimensional accuracy, i.e., the working accuracy of a bent product formed by this bending method, the present inventors investigated the cause of a decrease in the working accuracy in this bending method by carrying out numerous tests. As a result, they made the following findings.

(a) A metal material 1 which has been bent and cooled is being supported by line contact with the movable roller die 4 at the start of bending, so the contact position of the material 1 with the movable roller die 4 can be maintained.

(b) As working progresses, there is an unavoidable, gradual increase in the weight which acts on the portion of the metal material 1 which has passed through the movable roller die 4.

(c) As this weight increases, the metal material 1 comes to rotate about the position of line contact with the movable roller die 4. This rotation causes additional deformation of the heated portion 1*a*, thereby decreasing the working accuracy of the metal material 1.

(d) In addition to the above-described increase in weight, various disturbances such as thermal deformation of the metal material 1 due to nonuniform heating by the high frequency heating coil 5 or nonuniform cooling by the cooling device 6, variations in the initial material forming the metal material 1, and minute variations in other working conditions further cause the metal material 1 to rotate, resulting in further decreases in the working accuracy of the metal material 1.

(e) Rotation due to disturbances of the metal material 1 can be suppressed by supporting and constraining the portion of the metal material 1 which has passed through the movable roller die 4 with an additional movable roller, whereby a decrease in the working accuracy of the metal material 1 can be suppressed.

(f) Bending the metal material 1 with a large bending angle is impossible due to interference between the movable roller die 4 and other equipment. Furthermore, the movable rollers 4*a* strongly contact the surface of the metal material 1, causing a worsening of the surface condition of the metal material 1 or producing scratches, as a result of which yield and productivity decrease.

Based on these findings (a) to (f), the present inventors found that the invention disclosed by Patent Document 1 has the following problems 1-5.

(Problem 1) If bending is carried out on the metal material 1 by three-dimensional movement of the movable roller die 4, the rollers 4*a* of the movable roller die 4 are in line contact with the surface of the metal material 1. As a result, the surface condition of the metal material 1 changes or the surface of the rollers 4*a* is injured, and it becomes necessary to frequently replace the rollers 4*a*.

(Problem 2) The rollers 4*a* of the movable roller die 4 are in line contact with the surface of the metal material 1 while being rotatably supported by the body of the movable roller die 4. Due to the effect of disturbances such as the weight of the metal material 1, the working accuracy of the metal material 1 decreases, and a desired bending accuracy cannot be obtained.

(Problem 3) Due to the size of the rollers 4*a* of the movable roller die 4, the size of components associated with the rollers 4*a* (clamps, hydraulic cylinders, air cylinders, roll chucks, housings, and the like), the size of the heating device, and the size of the cooling device, it is not possible to perform bending of the metal material 1 at a bending angle which is greater than a certain angle. In particular, when the bending radius of the metal material 1 is small, the movable roller die and components associated with the rollers tend to interfere with the metal material 1 to such an extent that bending cannot be carried out.

(Problem 4) The cooling medium for cooling the heated metal material 1 is typically water-based. The cooling medium splatters and adheres to sliding portions of the movable roller die 4. As a result, rust develops on the sliding portions, and the apparatus is damaged. In addition, oxides (referred to below as scale) develop on the surface of the heated metal material 1. A portion of the scale which forms on the surface of the metal material 1 subsequently incorporates into the cooling medium in the subsequent cooling step and adheres to the movable roller die 4 or sliding portions thereof.

Scale which becomes enmeshed in the movable roller die 4 causes scratches in the surface of the rolls 4*a* or the product. If the rolls 4*a* are damaged, scars cyclically develop in the product.

The sliding portions of the movable roller die 4 form a precision positioning mechanism. If scale adheres to the sliding portions of the movable roller die 4 and produces damage, the lifespan of the mechanical parts constituting the movable roller die is shortened, and it becomes difficult to perform accurate positioning. Furthermore, it becomes necessary to frequently carry out maintenance with ceasing production for long periods or to employ a dust preventing measure such as covering of the entirety of sliding portions with a protective cover.

(Problem 5) In order to increase the accuracy of assembly of automobiles, there is a demand for increased dimensional accuracy of components of automobiles and automobile bodies. From the standpoints of increasing the productivity of the assembly of automotive bodies, increasing the stiffness of automobile bodies, and suppressing vibration and noise of automobile bodies, laser welding is beginning to be used in place of spot welding, which has been used in the past. Components which are subjected to laser welding preferably have a higher dimensional accuracy than components which are subjected to spot welding in order to ensure that the desired focal depth of a laser is obtained. Accordingly, it is necessary to further increase the dimensional accuracy of parts which are manufactured by the invention disclosed in Patent Document 1.

The object of the present invention is to provide a method and an apparatus for manufacturing a bent product which has excellent operating efficiency and which can provide a high working accuracy and enable a large bending angle in bending without damaging the surface condition of a metal material when performing bending of a metal material to obtain a widely varying bent shape or when it is necessary to carry out bending of a high strength metal material.

Means for Solving the Problem

The present invention is a method of manufacturing a bent product characterized by supporting an elongated metal material having a closed cross-sectional shape at a first position while feeding it in its lengthwise direction, locally heating the fed metal material at a second position which is downstream from the first position in the feed direction of the metal material, cooling the portion of the metal material which was heated at the second position at a third position downstream from the second position in the feed direction of the metal material, and changing the position of a gripping means, which grips the metal material in a region downstream of the third position in the feed direction of the metal material, in a three-dimensional direction including at least the feed direction of the metal material within a workspace including a space upstream of the third position in the feed direction of the metal material to impart a bending moment to the heated portion of the metal material, thereby manufacturing a bent product which has a three-dimensionally bent portion intermittently or continuously in the lengthwise direction of the product.

From another standpoint, the present invention is a manufacturing apparatus for a bent product characterized by having, in combination, a feed device for feeding an elongated metal material in its lengthwise direction, the metal material having a closed cross-sectional shape, a support device for supporting the fed metal material at a first position, a heating device for locally heating the fed metal material at a second position downstream of the first position in the feed direction of the metal material, a cooling device for cooling the portion of the metal material which was heated at the second position at a third position downstream of the second position in the feed direction of the metal material, and a gripping means, which can move in a three-dimensional direction including at least the feed direction of the metal material within a workspace including a space upstream of the third position in the feed direction of the metal material while gripping the fed metal material in a region downstream of the third position in the feed direction of the metal material to impart a bending moment to the heated portion of the metal material.

Effects of the Invention

According to the present invention, even when manufacturing a bent product having a bending direction which varies three-dimensionally and which require a widely varying bent shape and even when bending of a high strength metal material is necessary, a bent product having a high strength and good shape retention, a predetermined hardness distribution, and a desired dimensional accuracy can be efficiently and inexpensively manufactured.

Moreover, the present invention carries out bending of a metal material by gripping the metal material with a gripping means which is supported by an articulated robot or the like or a gripping means which is integrally formed with an articulated robot. As a result, the angle of bending can be set to a large value, deterioration in the surface condition or occurrence of surface scratches can be suppressed, bending accuracy can be guaranteed, and bending can be carried out with excellent operating efficiency.

Accordingly, the present invention can be widely applied, for example, as a bending technique for bent products for use in automobiles, which is being developed to a higher level.

LIST OF SYMBOLS IN THE DRAWINGS

Figure 1:
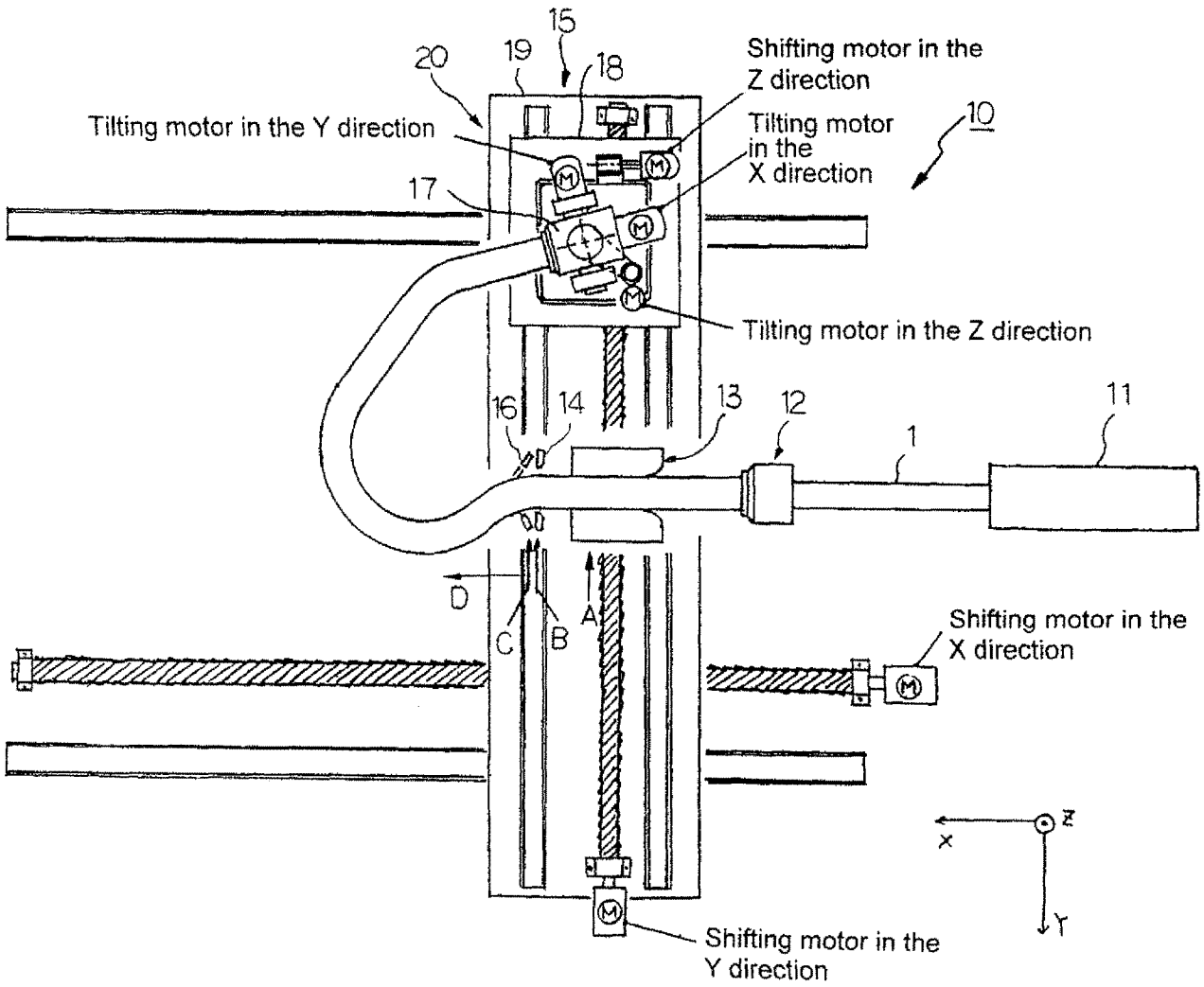
FIG. 1 is an explanatory view schematically showing in simplified form the structure of one example of a manufacturing apparatus for a bent product according to the present invention.

0 bending apparatus
1 metal material
2 support means
3 feed device
4 movable roller die
4*a* roll pair
5 high frequency heating coil
6 water cooling device
10, 10-1 manufacturing apparatus
11 feed device
12 gripping portion
13 support device
14 high frequency heating device
15 gripping means
16 cooling device
17 body
18 first base
19 second base
20 moving mechanism

Embodiments of the Invention

Below, a best mode for carrying out the present invention will be explained in detail while referring to the attached drawings.

FIG. 1 is an explanatory view schematically showing in simplified form the structure of one example of a manufacturing apparatus 10 for a bent product according to the present invention.

As shown in this figure, this manufacturing apparatus 10 comprises a feed device 11, a support device 13, a high frequency heating device 14, a cooling device 16, and a gripping means 15, which are individually explained below.

[Feed Device 11]

The feed device 11 feeds an elongated metal material 1 having a closed cross-sectional shape in its lengthwise direction.

An example of the feed device 11 is of a type using an electrically powered servo cylinder. The feed device 11 need not be limited to a specific type, and any known device of this type of feed device such as a type using a ball screw or a type using a timing belt or a chain or the like can be used well.

In the invention shown in FIG. 1, an example is given of the case in which the metal material 1 is a steel pipe having a circular transverse cross-sectional shape, in but the present invention is not limited to the case in which the metal material 1 is a steel pipe, and the present invention can be applied to a hollow metal material having a transverse cross-sectional shape which is rectangular, elliptical, oval, polygonal, a combination of a polygon and a circle, or a combination of a polygon and an ellipse in the same manner as for a steel pipe.

The metal material 1 is held by a holding member 12 and is fed in the axial direction (lengthwise direction) at a predetermined speed by the feed device 11. The holding member 12 serves the function of holding the metal material 1 so as to carry out feeding of the metal material 1, but it may be omitted when there is a support device 13.

[Support Device 13]

The support device 13 supports the metal material 1 which is fed in the axial direction by the feed device 11 at a first position A while enabling the metal material 1 to move.

An example of this type of support device 13 is a fixed guide, but it is not necessary to limit it to a specific type. A support device 13 can also use one or more pairs of opposing driven rolls, and any known support device of this type can be used well.

The metal material 1 is fed in the axial direction while passing through the installation position A of the support device 13. The support device 13 may be replaced by the holding member 12 shown in FIG. 1.

[High Frequency Heating Device 14]

The high frequency heating device 14 locally heats the fed metal material 1 at a second position B which is positioned downstream from the first position A in the feed direction of the fed metal material 1.

A coil which can perform high frequency induction heating of the metal material 1 can be used as the high frequency heating device 14. The high frequency heating device 14 can be any known type of high frequency heating device.

By varying the distance of the heating coil of the high frequency heating device 14 from the metal material 1 in a direction parallel to the direction perpendicular to the axial direction of the metal material 1, a portion of the metal material 1 being fed can be nonuniformly heated in its circumferential direction.

By also using at least one preheating means for the metal material 1 disposed on the upstream side of the high frequency heating device 14, the metal material 1 can be heated a plurality of times.

By also using at least one preheating means for the metal material 1 disposed on the upstream side of the high frequency heating device 14, it is possible to nonuniformly heat a portion of the metal material 1 being fed in the circumferential direction.

The metal material 1 is locally rapidly heated by the high frequency heating device 14.

[Cooling Device 16]

At a third position C downstream of the second position B in the feed direction of the metal material 1, the cooling device 16 cools the portion of the metal material 1 being fed which was heated at the second position B. In the area between position B and position C, the metal material 1 is heated to a high temperature and is in a state in which its deformation resistance is greatly decreased.

Any device which can provide a desired cooling rate can be used as the cooling device 16, and it is not necessary to limit it to a specific type of cooling device. As a typical example, a water cooling device which cools the metal material 1 by spraying cooling water at a predetermined position on the outer peripheral surface of the metal material 1 is used.

As shown in FIG. 1, the cooling water is sprayed at an angle with respect to the direction in which the metal material 1 is being fed. The region in the axial direction in which the metal material 1 is heated can be adjusted by varying the distance of the cooling means from the metal material 1 in a direction parallel to a direction perpendicular to the axial direction of the metal material 1.

The portion of the metal material 1 which was heated by the high frequency heating device 14 is locally rapidly cooled by the cooling device 16.

[Gripping Means 15]

The gripping means 15 is intended to impart a bending moment to the portion of the metal material 1 which was heated by the high frequency heating device 14 by moving in a three-dimensional direction including at least the feed direction of the metal material 1 within a workspace including a space on the upstream side of the third position C in the feed direction of the metal material 1 while gripping the metal material 1 being fed in a region D downstream of the third position C in the feed direction of the metal material 1. A chuck mechanism can typically be used as the gripping means.

In the present invention, it is of course possible to two-dimensionally move a gripping means which can move three-dimensionally. In this manner, bending in which the bending direction varies two-dimensionally can be carried out to manufacture a bent product, such as a bent product in which the bending direction of a metal material varies two-dimensionally as in S-bending.

The workspace is a three-dimensional space defined by the following Equations 1, 2, and 3.

$$x<0 \text{ and } (y=0 \text{ or } y\geq 0.5D) \text{ and } 0\leq\theta<360^\circ \quad (1)$$

$$x^2+(y-R\text{min})^2\geq R\text{min}^2 \quad (2)$$

$$x^2+(y+R\text{min})^2\geq R\text{min}^2-(0.5D-R\text{min})^2+(0.5D+R\text{min})^2 \quad (3)$$

In Equations 1-3, D means the smallest outer dimension (mm) of the bent product, Rmin means the smallest radius of curvature (mm) of the bent product, and x, y, and θ are the cylindrical coordinates having its origin at the second position in which the x-direction is the instantaneous feed direction of the metal material, the y-direction is the direction perpendicular to the x-direction in a horizontal plane, and θ is the angle in the circumferential direction.

The gripping means 15 carries out bending of the metal material 1 by three-dimensionally moving in this workspace to manufacture a bent product having a desired shape and intermittently or continuously having a bent portion in the lengthwise direction. The workspace is a space based on a technical idea, so when the operation of a manufacturing line or the like is fixed, a physical object which may optionally be installed may exist in this space.

The gripping means 15 has a body 17 having a cylindrical outer shape and a moving mechanism 20 on which the body 17 is mounted. The moving mechanism 20 is constituted by a second base 19 which is disposed so as to be able to move in the direction perpendicular to the feed direction of the metal material 1 (in the vertical direction in FIG. 1) and a second base 19 which is disposed so as to be able to move in the feed direction.

The first base 18 and the second base 19 are both moved by a ball screw and a drive motor. This moving mechanism 20 makes the body 17 movable two-dimensionally in a horizontal plane.

The body 17 is constituted by a hollow member having an inner peripheral surface with a shape which matches that of the outer peripheral surface of the metal material 1. The body 17 grips the metal material 1 by intimately contacting the outer surface of the leading end of the metal material 1.

In contrast to the example shown in FIG. 1, the body 17 may be constituted by a tube having an outer peripheral surface with a shape matching that of the inner peripheral surface of the metal material 1. In this case, the body 17 can grip the metal material 1 by being inserted into the leading end of the metal material 1.

Figure 2:
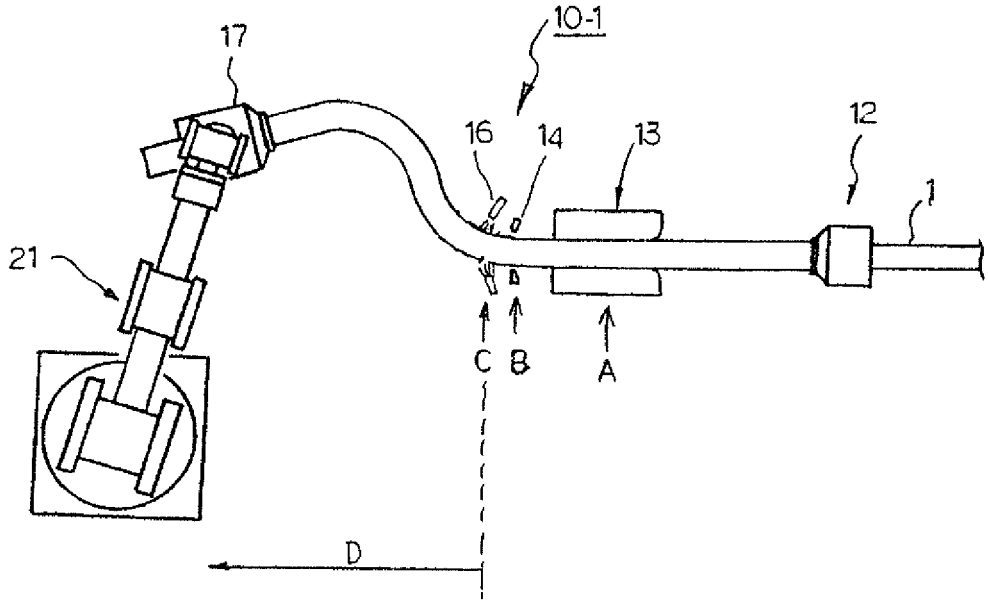
FIG. 2 is an explanatory view schematically showing the structure of a manufacturing apparatus using an articulated robot.
Figure 3:
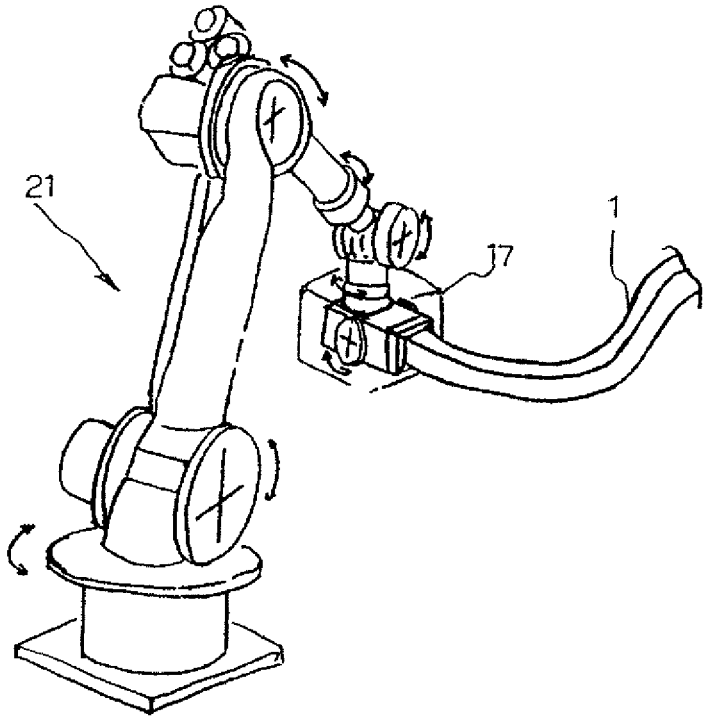
FIG. 3 is an explanatory view showing this articulated robot.
Figure 4:
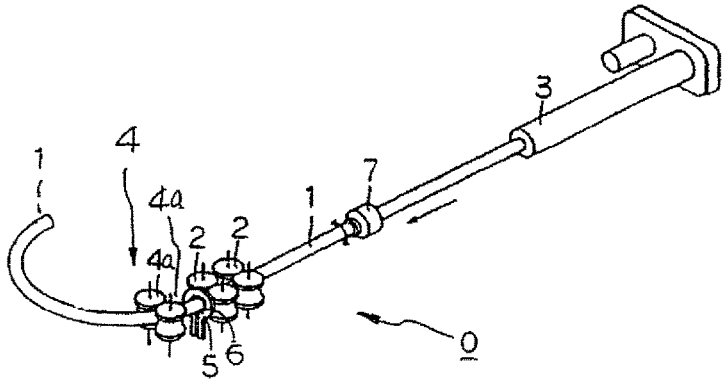
Fig. 4 PRIOR ART
FIG. 4 is an explanatory view schematically showing a bending apparatus according to the invention disclosed by the present applicant in Patent Document 1.
Figure 5:
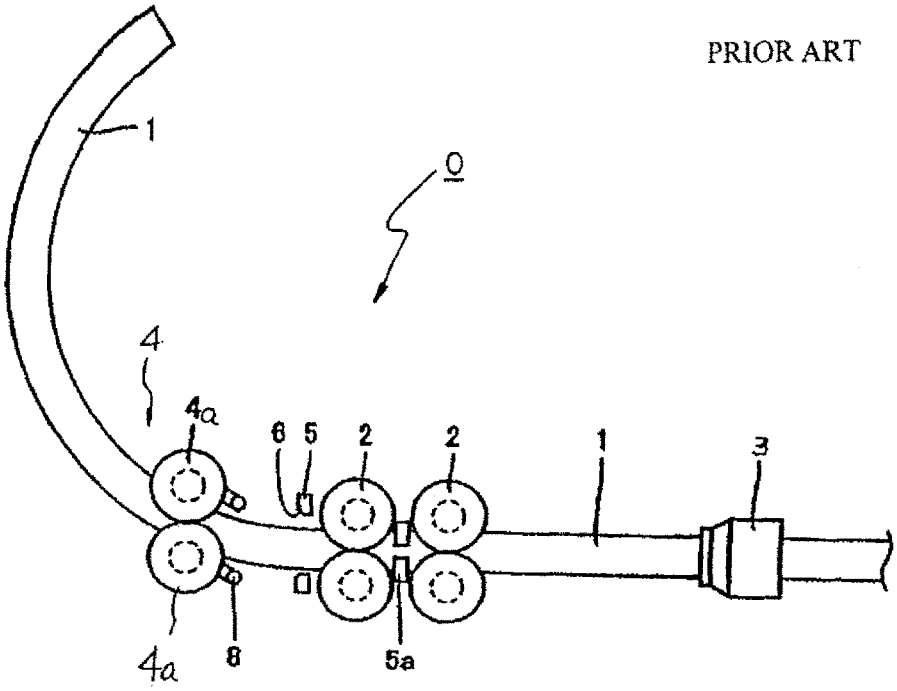
Fig. 5 PRIOR ART
FIG. 5 is an explanatory view schematically showing a bending apparatus according to the invention disclosed by the present applicant in Patent Document 1.
Figure 6:
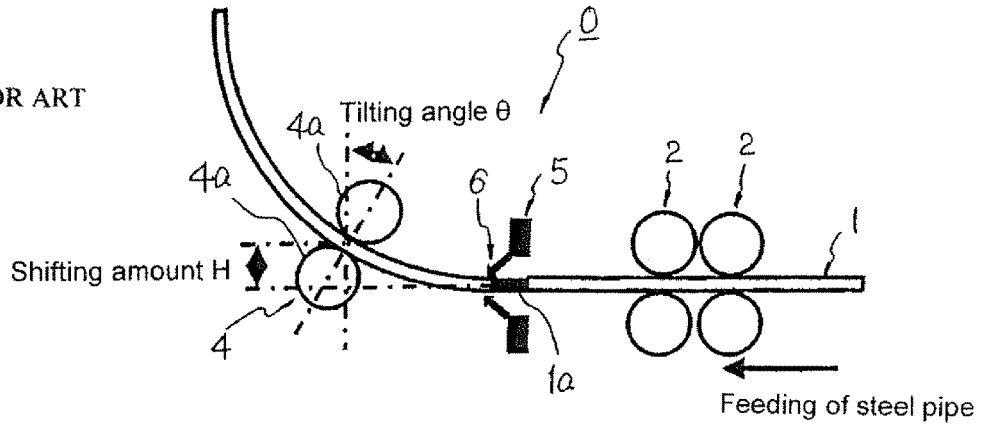
Fig. 6 PRIOR ART
FIG. 6 is an explanatory view schematically showing a working method disclosed in Patent Document 1.

Instead of being supported by the moving mechanism 20 shown in FIG. 1, the body 17 can be supported using an articulated robot having a joint which can rotate about at least one axis. FIG. 2 is an explanatory view schematically showing the structure of a manufacturing apparatus 10-1 using an articulated robot 21, and FIG. 3 is an explanatory view showing this articulated robot 21.

By using this articulated robot 21, the body 17 can be easily supported so as to be able to move in a three-dimensional direction including at least the feed direction of the metal material 1.

Next, the manufacture using this manufacturing apparatus 10 of a bent product either intermittently or continuously having in its lengthwise direction a bent portion which is bent three-dimensionally will be explained.

First, an elongated metal material 1 having a closed cross-sectional shape is supported at a first position A by the support device 13 and is fed in its lengthwise direction by the feed device 11.

Next, the following steps (a) to (c) are carried out continuously in accordance with the target shape of a product: (a) locally heating the metal material 1 being fed at a second position B downstream from the first position A in the feed direction of the metal material 1 by means of the high frequency heating device 14, (b) cooling the portion of the metal material which was heated at the second position B by the cooling device 16 at a third position C downstream of the second position B in the feed direction of the metal material 1, and (c) varying the position of the gripping means 15, which grips the metal material 1 in a region D downstream from the third position C in the feed direction of the metal material 1, in a three-dimensional direction including at least the feed direction of the metal material within a workspace including a space on the upstream side of the third position C in the feed direction of the metal material 1 to impart a bending moment to the heated portion of the metal material 1.

As a result, a bent product intermittently or continuously having in its lengthwise direction a bent portion which is bent three-dimensionally and which is shaped by bending produced by the above-described bending moment is continuously manufactured.

At this time, by locally heating the metal material 1 at the second position B to a temperature at which quenching is possible and cooling it at a predetermined cooling rate at the third position C, the heated portion of the metal material 1 can be quenched, whereby a bent product intermittently or continuously having a quenched portion at least in the lengthwise direction and/or in the circumferential direction in a cross section crossing the lengthwise direction can be manufactured.

A bent product can be continuously manufactured by disposing the manufacturing apparatus 10 either (a) in a continuous manufacturing apparatus for a bent product which is incorporated in a seam welded pipe manufacturing line constituted by an uncoiler which continuously pays out a steel strip, a forming means which forms the paid out steel strip into a pipe having a predetermined cross-sectional shape, a welding means which welds the abutting side edges of the steel strip to form a continuous pipe, and a post-treatment means which cuts off the weld bead and if necessary performs post-annealing or sizing, the apparatus 10 being disposed on the exit side of the post-treatment means, or (b) in a continuous manufacturing apparatus for a bent product which is incorporated in a roll forming line constituted by an uncoiler which continuously pays out a steel strip and a shaping means which shapes the paid out steel strip into a predetermined cross-sectional shape, the apparatus 10 being disposed on the exit side of the shaping means.

According to the present invention, even when manufacturing a bent product which requires a widely varying bent shape and which has a bending direction which varies three dimensionally and even when it is necessary to perform bending of a metal material having a high strength, it is possible to efficiently and inexpensively manufacture a bent product having a high strength, good shape retention, a predetermined hardness distribution, a desired dimensional accuracy, and a bending radius of curvature which is not constant in the lengthwise direction but which has at least two bent portions of different radius of curvature in the lengthwise direction.

Moreover, a metal material is subjected to bending while being gripped by a gripping means which is supported by an articulated robot or the like. Therefore, a large bending angle can be guaranteed, deterioration in the surface condition and occurrence of surface scratches can be suppressed, bending accuracy can be guaranteed, and bending with excellent operating efficiency is possible.

Accordingly, the present invention can be widely employed, for example, as a bending technique for bent products to be used in automobiles, which is being developed to a higher level.

The invention claimed is:

1. An apparatus for manufacturing a bent product characterized by comprising, in combination, a feed device for feeding a long metal material in its lengthwise direction, a support means for supporting the metal material being fed at a first position, a heating means for locally heating the metal material being fed at a second position downstream of the first position in the feed direction of the metal material, a cooling device for cooling the portion of the metal material being fed which was heated at the second position at a third position downstream of the second position in the feed direction of the metal material, a chucking mechanism which moves in a three-dimensional direction while gripping the metal material in a region downstream of the third position in the feed direction of the metal material, and an articulated robot having six axes with the chucking mechanism fixed at a free end.

* * * * *